US005437256A

United States Patent [19]

Woletz et al.

[11] Patent Number: 5,437,256

[45] Date of Patent: Aug. 1, 1995

[54] METHOD OF CHECKING THE OPERABILITY OF A REGENERATION VALVE IN A TANK VENTING SYSTEM

[75] Inventors: Wolfgang Woletz, Esslingen; Hans Schröter, Stuttgart; Klaus Schust, Weinstadt; Hartmut Kolb, Ludwigsburg, all of Germany

[73] Assignee: Mercedes-Benz AG, Stuttgart, Germany

[21] Appl. No.: 204,790

[22] Filed: Mar. 2, 1994

[30] Foreign Application Priority Data

Mar. 6, 1993 [DE] Germany ..... 43 07 100.7

[51] Int. Cl.[6] ..... F02M 33/02

[52] U.S. Cl. ..... 123/519; 123/520

[58] Field of Search ..... 123/518, 519, 520, 198 D

[56] References Cited

U.S. PATENT DOCUMENTS

| | | | |
|---|---|---|---|
| 5,146,902 | 9/1992 | Cook et al. | 123/520 |
| 5,158,054 | 10/1992 | Otsuka | 123/520 |
| 5,193,512 | 3/1993 | Steinbrenner et al. | 123/520 |
| 5,197,442 | 3/1993 | Blumenstock et al. | 123/520 |
| 5,261,379 | 11/1993 | Lipinski et al. | 123/520 |
| 5,263,462 | 11/1993 | Reddy | 123/520 |
| 5,267,470 | 12/1993 | Cook | 123/520 |
| 5,275,144 | 1/1994 | Gross | 123/520 |
| 5,317,909 | 6/1994 | Yamada et al. | 123/520 |
| 5,333,590 | 8/1994 | Thomson | 123/520 |
| 5,339,788 | 8/1994 | Blumenstock et al. | 123/520 |
| 5,349,935 | 9/1994 | Mezger et al. | 123/520 |
| 5,386,812 | 2/1995 | Curran et al. | 123/520 |

FOREIGN PATENT DOCUMENTS

| | | |
|---|---|---|
| 4111361 | 10/1992 | Germany . |
| 4112481 | 10/1992 | Germany . |
| 4122635 | 1/1993 | Germany . |

*Primary Examiner*—Thomas N. Moulis
*Attorney, Agent, or Firm*—Klaus J. Bach

[57] ABSTRACT

The invention relates to a method for checking the operability of a cyclically controlled regeneration valve in a tank venting system of a motor vehicle which utilizes the realization that during operation of the system significant pressure variations are generated in a discharge line arranged between an adsorption filter and the regenerating valve whenever the duty ratio of the regeneration valve is within a certain range. If the regeneration valve is operated at such a duty ratio, the pressure variations in the discharge line are recorded and the extreme pressure valves are determined in an evaluation device for a specified time period after which the difference between the maximum and the minimum pressures is determined and if this difference is below a predetermined threshold, the regeneration valve is indicated as being defective.

4 Claims, 2 Drawing Sheets

METHOD OF CHECKING THE OPERABILITY OF A REGENERATION VALVE IN A TANK VENTING SYSTEM

BACKGROUND OF THE INVENTION

The invention relates to a method of checking the operability of a cyclically controlled regeneration valve in a tank venting system of a motor vehicle.

German Offenlegungsschrift 4,112,481 discloses a method of this kind, by means of which it is possible to check the operability of the regeneration valve and that of the entire tank venting system. Here, the differential pressure in the tank venting system relative to the ambient pressure is first measured with the regeneration valve open and then with the regeneration valve closed. The change in the differential pressure calculated therefrom is then compared with a threshold value and the tank venting system is considered to be functional if the change in the differential pressure exceeds the threshold value. This method has the disadvantage that it is necessary to close the regeneration valve to check its operability and, as a result, the normal operation of the tank venting system must be interrupted for the duration of the operability check.

It is therefore the object of the invention to provide a method by which the operability of a cyclically controlled regeneration valve in a tank venting system can be checked without interrupting normal operation.

SUMMARY OF THE INVENTION

The invention relates to a method for checking the operability of a cyclically controlled regeneration valve in a tank venting system of a motor vehicle which utilizes the realization that during operation of the system significant pressure variations are generated in a discharge line arranged between an adsorption filter and the regeneration valve whenever the duty ratio of the regeneration valve is within a certain range. If the regeneration valve is operated at such a duty ratio, the pressure variations in the discharge line are recorded and the extreme pressure values are determined in an evaluation device for a specified time period after which the difference between the maximum and the minimum pressures is determined and if this difference is below a predetermined threshold, the regeneration valve is indicated as being defective.

These pressure variations can be recorded during normal operation of the tank venting system and evaluated by the evaluation device so that interruption of the operation of the tank venting system for evaluation of the regeneration valve is not necessary.

For reasons of cost, the pressure can be recorded by means of a switchable pressure sensor which, during the normal operation of the tank venting system, is connected to the intake pipe of the internal combustion engine in order to measure the intake vacuum and is only connected to the discharge line of the adsorption filter during the operability check of the regeneration valve, for recording the pressure variations.

The method according to the invention is described in greater detail below with reference to the drawings.

DESCRIPTION OF A PREFERRED EMBODIMENT

Figure 1:
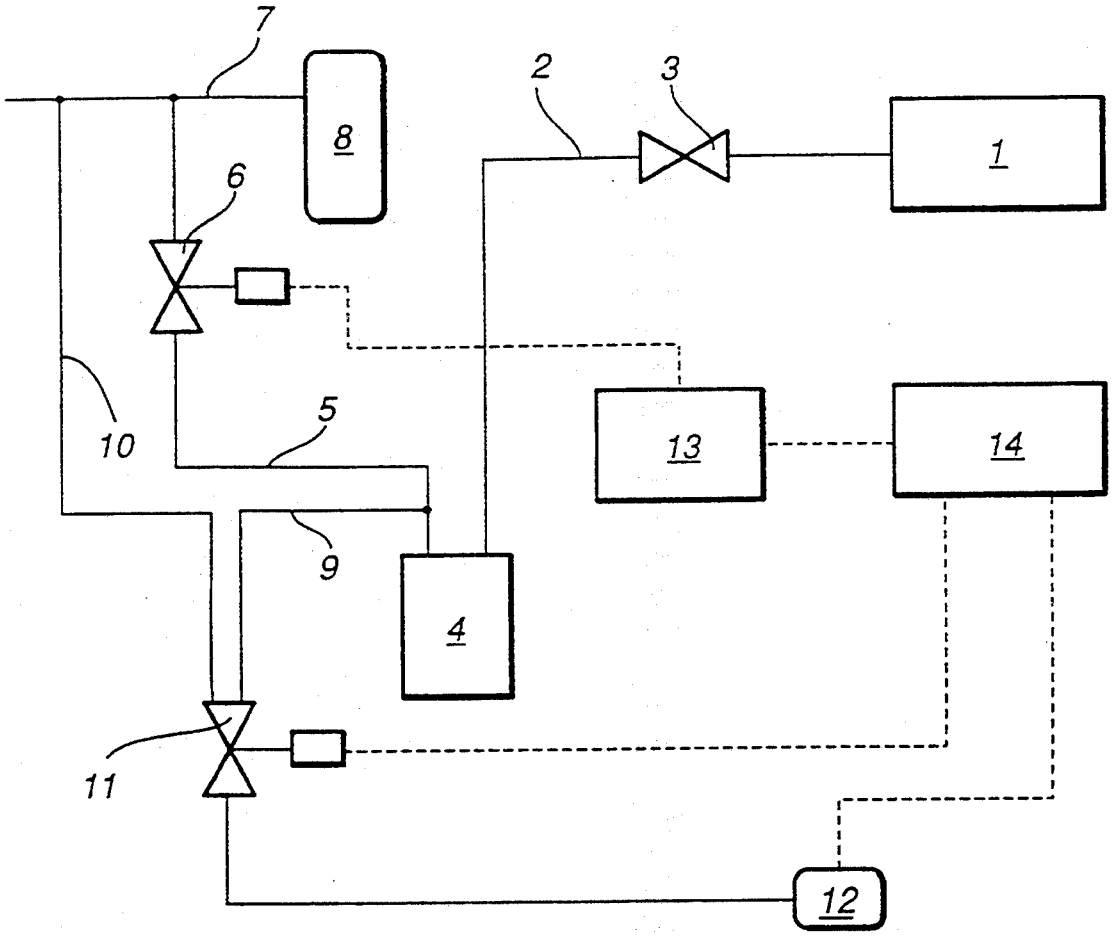
FIG. 1 is a schematic representation of a tank venting system with a cyclically controlled regenerating valve and FIG. 2 is a flow chart of a method according to the invention.

The tank venting system depicted in FIG. 1 comprises a fuel tank 1 which is connected to an adsorption filter 4 via a connecting line 2 in which a tank venting valve 3 is arranged. The adsorption filter 4 is generally a container filled with activated carbon. The adsorption filter 4 is in turn connected, via a discharge line 5, in which a cyclically controlled regeneration valve 6 is arranged, to an intake pipe 7 of an internal combustion engine 8. In addition, the discharge line 5 and the intake pipe 7 are selectively connectable via lines 9, 10, by means of a switchable electrically operated valve 11, to an absolute pressure sensor 12.

The fuel vapors which form in the fuel tank 1 are conducted via a connecting line 2 into the adsorption filter 4, where they are stored. From the adsorption filter 4, the fuel vapors can be passed via the discharge line 5 into the intake pipe 7. The volume of fuel vapors supplied to the intake pipe 7 can be regulated by means of the cyclically controlled regeneration valve 6. For this purpose, the regeneration valve 6 is operated at a fixed repetition frequency by a motor control unit 13 as a function of operating parameters, with a variable duty (on-off) ratio TAV. In addition, an evaluation device 14 is provided to check the operability of the regeneration valve 6. The duty ratio TAV is transmitted by the motor control unit 13, via a central data bus, for example, to the evaluation device 14, which initiates the operability check in dependence on the duty ratio. To start the operability check, the evaluation device 14 sends a switching pulse to the electrically operated valve 11, so as to switch the valve 11 to expose the absolute pressure sensor 12 to the pressure in the discharge line 5. The pressure signal recorded is then transmitted in turn from the absolute pressure sensor 12 to the evaluation device 14, where it is evaluated.

Figure 2:
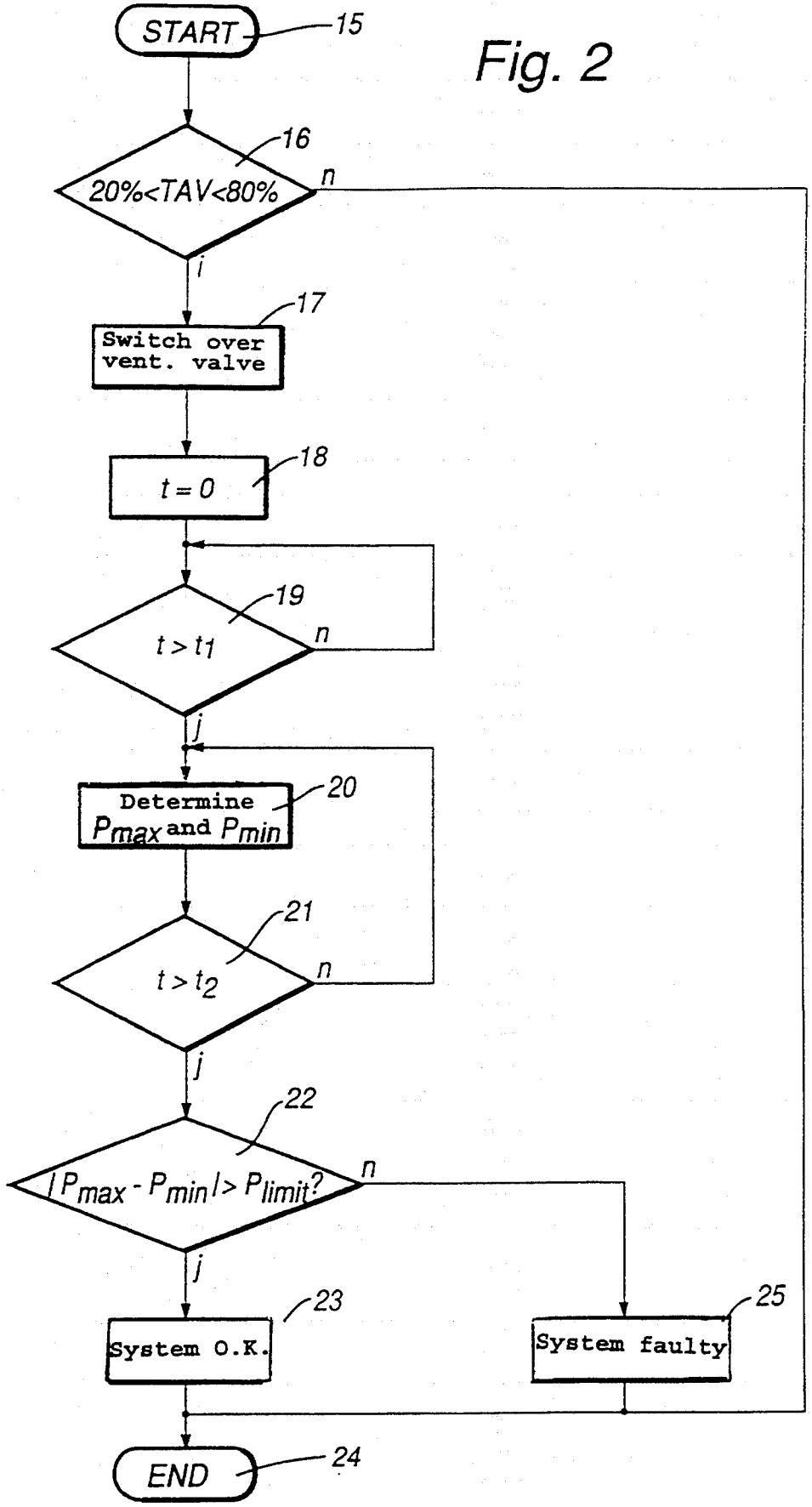

An illustrative embodiment of the method according to the invention is depicted in FIG. 2. After the start of the method in block 15, a check is made in block 16 to determine whether the duty ratio TAV applied to the regeneration valve 6 is in a range of between 20% and 80%. If this is not the case, the method is interrupted since, outside this duty ratio range, no evaluable pressure variations are generated in the discharge line 5. If the duty ratio is within the specified range however, then, in block 17, a switching signal is sent to the electrically operated valve 11 by the evaluation device 14. As a result, the absolute pressure sensor 12 is no longer subjected to the intake vacuum via line 10 but is switched over to sense the pressure in the discharge line 5 via line 9.

In block 18, the timing is then initiated and, following this, a check is made in block 19 to determine whether a specified first time period $t_1$ has passed. If this is not the case, the program loops back to the beginning of block 19 until the time period $t_1$ has passed. This first time period $t_1$, for example, 1 second, is required to permit build-up of a stable pressure at the absolute pressure sensor 12 after the switching operation of the electrically operated valve 11.

Once the time period $t_1$ has elapsed, the extreme values $P_{max}$ and $P_{min}$ of the pressure variation are determined in block 20 by the evaluation device 14. To suppress any noise signals which may occur, the signals may also be passed separately via low-pass filters. A check is then made in block 21 to determine whether a specified second time period $t_2$, for example, 5 seconds, has passed. Until this is the case, the program branches back to the beginning of block 20. Only when this second time period $t_2$ has elapsed is a check made in block 22 to determine whether the difference between the extreme pressure values ($P_{max}-P_{min}$) exceeds a specified threshold $P_{limit}$. If this is the case, the system recognizes in block 23 that the regeneration valve 6 is functional and the method is then ended in block 24. If, on the other hand, the difference between the extreme pressure values ($P_{max}-P_{min}$) in block 22 is below the specified threshold $P_{limit}$, the program branches to block 25, where it is ascertained that the regeneration valve 6 is not working properly. At this point, a fault routine may be started. For this purpose, a fault signal may, for example, be sent to the engine control unit or a warning signal may be generated for the driver. The method is then ended in block 24.

Numerous variations of the method according to the invention are conceivable in addition to the illustrative embodiment described above. Instead of the absolute pressure sensor and the electrically operated valve, for example, it is also possible to employ two separate pressure sensors for sensing the intake pressure and the pressure in the discharge line. The permissible range for the duty ratio of the regenerating valve, upon which the initiation of the operability check depends, furthermore may depend on numerous variables, and different permissible ranges may thus be suitable for different arrangements.

What is claimed is:

1. A method of checking the operability of a cyclically controlled regeneration valve in a fuel tank venting system of a motor vehicle comprising an adsorption filter which is connected, via a connecting line, to the fuel tank and, via a discharge line in which the regeneration valve is arranged, to an intake pipe of an engine, with a pressure sensor being provided so as to be able to sense the pressure in the discharge line of said adsorption filter and supply its pressure signal to an evaluation device for determining operability of said regeneration valve, said method comprising the steps of: determining a duty ratio (TAV) of the regeneration valve as an exclusive result of the control of the tank venting system, initiating a regeneration valve operability check if said duty ratio is within a specified range, determining during the operability check in the evaluation device the extreme values ($P_{max}$, $P_{min}$) of the pressure variations for a predetermined period of time and indicating inoperability of the regeneration valve if, after expiration of the predetermined time period, the difference between the extreme pressure values ($P_{max}$, $P_{min}$) is below a predetermined threshold ($P_{limit}$).

2. A method according to claim 1, wherein said operability check is only performed if the duty ratio (TAV) of the regenerating valve is between 20% and 80%.

3. A method according to claim 1, wherein an absolute pressure sensor present in the motor vehicle and normally connected to measure the air pressure in the intake pipe is switched during the operability check so as to measure the pressure in the line between the adsorption filter and the regeneration valve.

4. A method according to claim 3, wherein after the switching over of the absolute pressure sensor, the operability check is started only after a predetermined waiting period.

* * * * *